US007024743B2

(12) United States Patent
Heaton

(10) Patent No.: US 7,024,743 B2
(45) Date of Patent: Apr. 11, 2006

(54) GARBAGE MACERATOR INSTALLATION MOUNT

(76) Inventor: Kenneth Heaton, 4533 Josie Ave., Lakewood, CA (US) 90713

( * ) Notice: Subject to any disclaimer, the term of this patent is extended or adjusted under 35 U.S.C. 154(b) by 190 days.

(21) Appl. No.: 10/843,602

(22) Filed: May 11, 2004

(65) Prior Publication Data

US 2005/0251983 A1 Nov. 17, 2005

(51) Int. Cl.
*B66F 3/08* (2006.01)

(52) U.S. Cl. ..... 29/271; 29/256; 29/266; 254/98; 254/100; 254/133 R; 254/134; 248/354.3

(58) Field of Classification Search ..... 29/271, 29/256, 266; 254/98, 100, 133 R, 134; 248/354.3
See application file for complete search history.

(56) References Cited

U.S. PATENT DOCUMENTS 5,297,779 A * 3/1994 Collins et al. ..... 254/98

* cited by examiner

*Primary Examiner*—Robert C. Watson
(74) *Attorney, Agent, or Firm*—Michael Bak-Boychuk

(57) ABSTRACT

A support assembly useful in aligning and mounting a garbage disposal to the drain fitting of a sink includes a base provided with a vertical tube segment supporting a nut assembly threadably engaged to a rod partly received in the segment with the upper rod end supporting an adapter conformed to the disposal. An offset bar fixed to the rod exterior engages a lateral recess on the segment to fix the rod in rotation as the nut assembly is turned. The assembly may include rods of differing lengths and adapters of various forms.

8 Claims, 2 Drawing Sheets

GARBAGE MACERATOR INSTALLATION MOUNT

BACKGROUND OF THE INVENTION

1. Field of the Invention

The present invention relates to tools useful in plumbing assembly, and more particularly to manually adjustable installation supports useful in aligning the throat of a sink macerator or garbage disposal subjacent the drain opening in the sink.

2. Description of the Prior Art

A food debris macerator, or garbage disposal, in current implementation comprises an electromechanical structure of some bulk and mass. While many improvements have made this device quite reliable, the complex nature of the mechanism and the frequency of its use and abuse make it an item of frequent attention. Most often this attention requires removal and replacement, or re-installation following repair, of the device to the underside of the sink drain opening, a task requiring manipulation of a fairly heavy and cumbersome article within the narrow and crowded confines of the cavity under the sink.

Various tools have been devised in the past that assist in this difficult task, most often taking the form of a threaded puller supported over the drain opening and extending through the drain fitting to suspend the macerator. Examples of such prior art devices can be found in the teachings of U.S. Pat. No. 6,557,229 to Ricci, U.S. Pat. No. 5,177,853 to Herook and others. While suitable for the purposes intended support mechanisms of this nature typically deploy the adjustment elements of the tool on top of or inside the sink cavity while all the alignments are made within the cabinet under the sink. This distant adjustment facility of these prior art devices has rendered their use less than fully convenient.

Those skilled in the art will appreciate that the alignment task of a disposal installation entails several aspects, including the attachments of the disposal to the sink flange, the connection of electrical leads and also the connection of the various drain lines. These tasks are all effected within the narrow confines of the sink cabinet. A disposal support mechanism that is conveniently manipulated with one hand while the other elements are brought out for connection with the other is therefore extensively desired and it is one such support mechanism that is disclosed herein.

SUMMARY OF THE INVENTION

Accordingly, it is the general purpose and object of the present invention to provide an adjustable mount assembly adapted to engage variously configured food debris macerators for adjustable deployment thereof subjacent a sink drain.

Other objects of the invention are to provide an adjustable support assembly for manual alignment of a macerator or disposal under a sink drain.

Further objects of the invention are to provide a support assembly useful in positioning a food debris macerator into its mounting alignment under a sink drain opening.

Yet other objects of the invention are to provide an installation support useful in installing garbage disposals which is adaptable to various disposal configurations and is easily manipulated for proper alignment.

Briefly these and other objects are accomplished within the present invention by providing a generally planar mounting surface conformed to threadably engage one end of a pipe segment in a generally orthogonal projection from one surface thereof The free end of the segment is both finished to form a smooth bearing surface and is further fixed to the upper end of a longitudinal channel to provide a radial recess extending longitudinally along the exterior surface of the segment. A selected one of a complement of various length threaded rods first threaded through the interior of a nut assembly is then inserted into the segment such that the extending portion thereof is then receivable within the upper opening of the segment with the nut assembly supported on the surrounding bearing surface. In this manner rotary advancement of the nut assembly raises and lowers the free projecting end of the inserted rod which may be threadably secured to one of several adaptor fixtures conformed to mate with a corresponding bottom structure of the disposal that is being installed. To prevent the adaptor-rod combination from turning with the nut assembly as it is rotated a threaded sleeve mounted on the rod is locked by compression against the adaptor to deploy a longitudinal bar along the rod exterior into the recess in the channel along the pipe segment.

Those skilled in the art will further appreciate that the foregoing combination is easily conformed to various sink cabinet and disposal geometries. In each instance, moreover, the thread pitch of the nut assembly and weight of the disposal are combined with the contact dimensions of the base plate to preclude the rotary movement thereof as the disposal is raised. The plumber engaged in the replacement or re-installation task thus needs only one hand to manipulate the nut assembly leaving the other hand free for drain fitting alignment by a simple and reliable tool is resolving a tedious and cumbersome task.

BRIEF DESCRIPTION OF THE DRAWINGS

FIG. 5 is a further perspective illustration of the inventive support assembly detail, illustrating another adaptation thereof to a particular disposal.

DESCRIPTION OF THE PREFERRED EMBODIMENT

Figure 1:
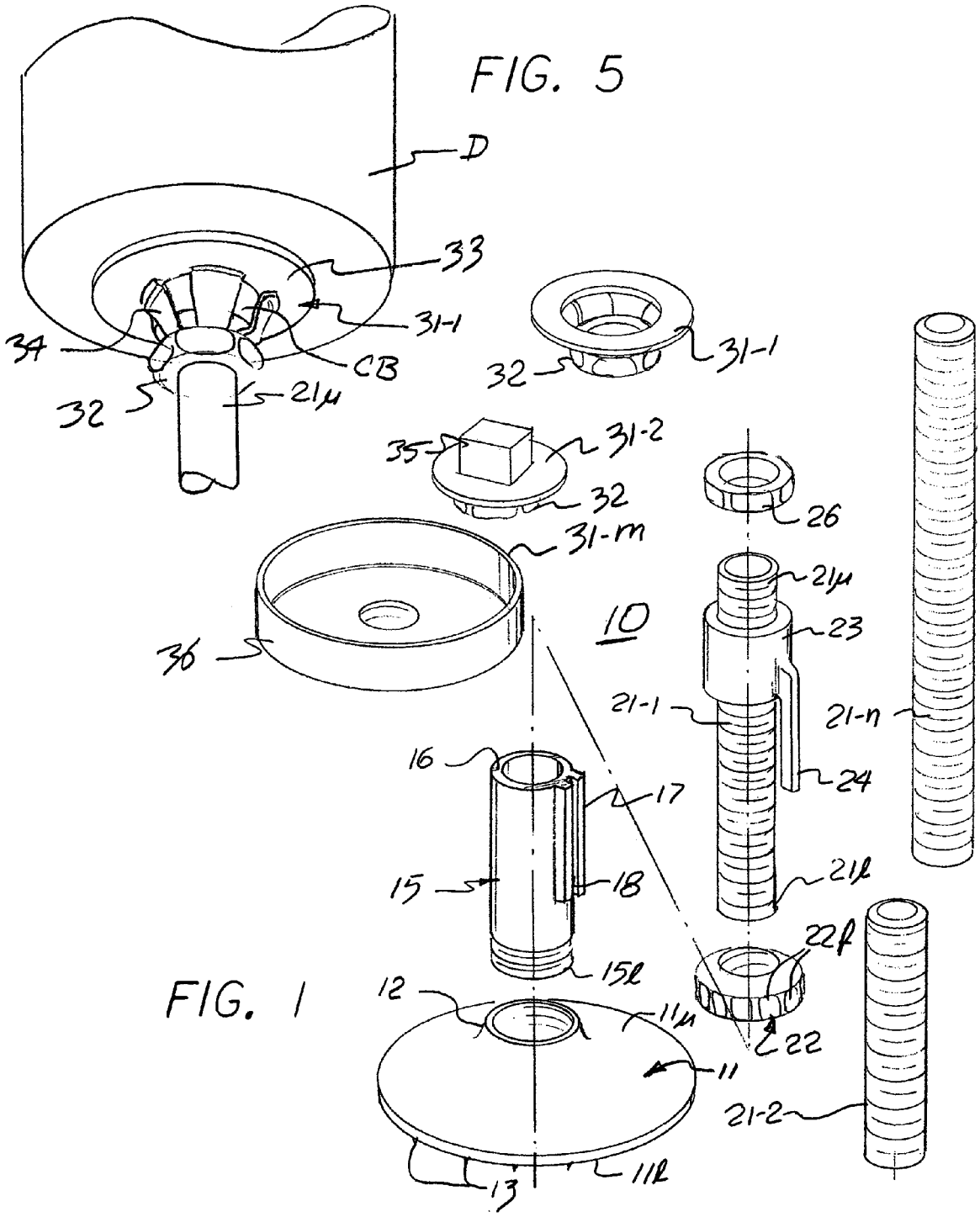
FIG. 1 is a perspective illustration, separated by parts, of the inventive support assembly useful in the course of installation of a food debris macerator or garbage disposal.
Figure 2:
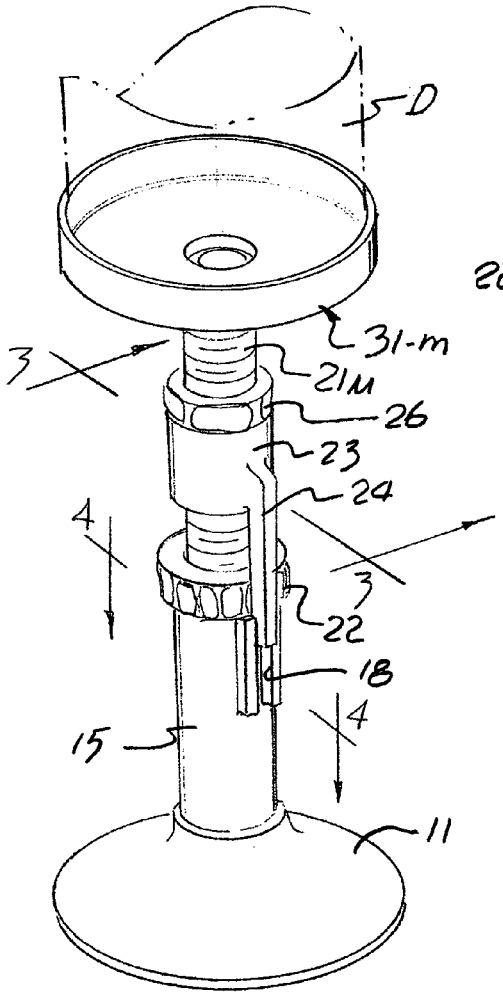
FIG. 2 is yet another perspective illustration of the inventive support assembly in its deployed form.
Figure 3:
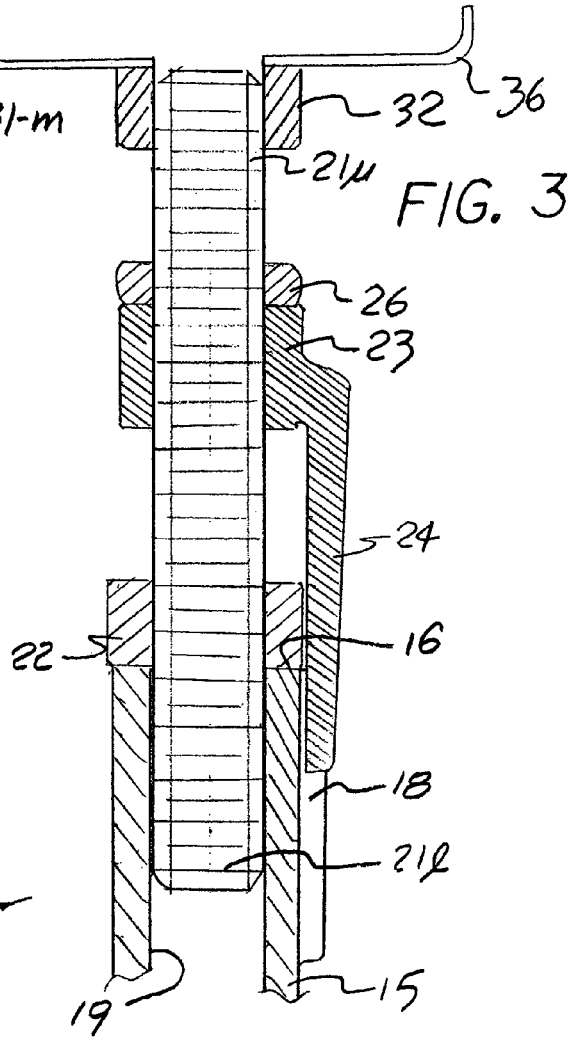
FIG. 3 is a sectional view taken along line 3—3 of FIG. 2.
Figure 4:
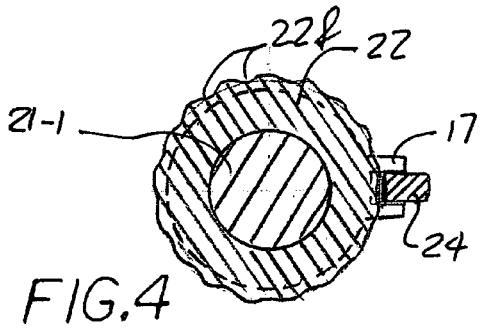
FIG. 4 is yet another sectional view taken along line 4—4 of FIG. 4.

As shown in FIGS. 1–4, the inventive support assembly, generally designated by the numeral 10, comprises a base 11 of a generally planar configuration provided with a threaded boss 12 on the upper surface 11*u* thereof. The peripheral edge surface of the lower surface 11*l* may be finished to a rough finish, shown by projections 13, to increase frictional resistance to any rotary displacement thereof A pipe segment 15 exteriorly threaded over the lower end surface 15*l* is then threadably insertable into the boss 12 to form a vertically aligned annular structure supported on the base and defined at the upper end 15*u* by a smoothed end surface 16. A longitudinally aligned channel piece 17 is then affixed to the outer surface of segment 15 to present a radially directed recess 18 extending from surface 16 along a portion of segment 15.

A selected one of a plurality of threaded rods 21-1 through 21-n, shown as rod 21-1 in the Figure, is then threadably received in the interior of a nut assembly 22 to extend a lower portion 21*l* into the interior bore 19 of segment 15. This extension is limited by the resting abuttment of the assembly 22 against the smoothed surface 16 and is adjustable by the rotary advancement of the assembly on rod 21-1. In this manner the extension of the upper rod portion 21*u* is manually selectable by rotary manipulation of the nut assembly. To allow for such one-handed manipulation of the nut assembly 22 on rod 21-1 a threaded sleeve 23 is advanced onto the upper rod segment 21*u* to deploy an offset bar 24 aligned for receipt within recess 18, thus fixing the rod in rotation. To further secure sleeve 23 on the rod a clamping nut 26 may be provided, or alternatively the sleeve may be compressed against any support adaptors that may be threaded onto the rod end. Of course, these alternatives depend on the length of the rod selected and the desired height of the adapter deployment, a dimension determined by the size of the article supported on the adapter and the height to which it needs to be raised.

Those skilled in the art will appreciate that commercially available disposals D are variously implemented and the geometry of their lower surfaces will therefore need various conforming support structures. For this reason a plurality of adapters 31-1 through 31-m is provided as a part of the assembly array each conformed to a particular disposal geometry and each characterized by a central mounting nut 32 conformed for mounting on the corresponding upper rod end 21*u*. For example, for those configurations of the disposal D provided with an annular central boss CB (see FIG. 5) the structure of adapter 31-1 provides an annular ring 33 mounted on nut 32 by a spider 34. Alternatively, disposals D provided with a key opening in their lower surface for clearing jams may take advantage of the adapter 31-2 provided with an upward key 35 and configurations that include a flat lower surface may use the dished support 36 shown on adaptor 31-m (and illustrated in FIGS. 2 and 3). Of course, other disposal shapes can be similarly accommodated.

In each instance it is the deployment convenience of a support structure that is easily adjusted that is desired, particularly when raising the disposal into compressive contact with the seals and brackets that form the mounting structure. To preclude inadvertent reduction in height a retention interlock is conveniently formed by providing a series of flats or depressions 22*d* on the periphery of the nut assembly 22 on which the offset bar 24 rests as it is cantilevered from sleeve 23. The manual advancement of the nut assembly is therefore against a spring bias, assuring positive engagement at the position selected. In this manner a conveniently assembled tool is provided that is easily configured for various installation geometries. Moreover, the generally conventional nature of most of the components of the assembly assures a broad selection of materials such as metal, PVC or other polymeric structures.

Of particular interest to those engaged in the installation or re-installation of disposals and macerators is the range of utility of this support assembly which can be further expanded by combining the several pieces in any selection. For example the very short rod 21-2 may be combined with one of the other, longer, ones by threaded insertion into both the ends of sleeve 23 and the annular support 31-1 may be combined with adapter 31-2 for those instances where both a key opening and a central boss is included in the disposal end. Thus a wide range of shapes and dimensions is conveniently accommodated.

Obviously, many modifications and variations can be effected without departing from the spirit of the invention instantly disclosed. It is therefore intended that the scope of the invention be determined solely by the claims appended hereto.

The invention claimed is:

1. An assembly useful in raising a food debris macerator into mounting alignment subjacent a sink drain, comprising:

a base structure characterized by a base plate supporting a generally vertical tubular segment provided with a radially aligned recess on the exterior periphery thereof adjacent an upper opening in said segment;

a threaded rod defined by an upper and a lower end threadably engaged to extend said lower end through a nut assembly for receipt into the upper opening of said segment and to threadably extend said upper end through a sleeve provided with an offset bar extending over said nut assembly into said recess; and an adapter attachable to said upper end of said rod and conformed to support said macerator.

2. An assembly according to claim 1, wherein:

said rod is selected from a group of rods of various lengths; and said adapter is selected from a group of adapters each conformed for supporting a particularly configured macerator.

3. An assembly, according to claim 2, wherein:

said nut assembly includes a periphery provided with a plurality of radial depressions; and said bar is cantilevered from said sleeve to extend through a selected one of said depressions.

4. An assembly useful in raising a food debris macerator into mounting alignment subjacent a sink drain, comprising:

a base structure characterized by a base plate supporting a generally vertical tubular segment provided with a radially aligned recess on the exterior periphery thereof adjacent an upper opening in said segment;

a threaded rod selected from a group of rods of various lengths each defined by an upper and a lower end threadably engaged to extend said lower end through a nut assembly for receipt into the upper opening of said segment and to threadably extend said upper end through a sleeve provided with an offset bar extending over said nut assembly into said recess; and an adapter selected from a group of adapters each conformed for supporting a particularly configured macerator and each attachable to said upper end of said rod and conformed to support said macerator.

5. An assembly, according to claim 4, wherein:

said nut assembly includes a periphery provided with a plurality of radial depressions; and said bar is cantilevered from said sleeve to extend through a selected one of said depressions.

6. A mounting tool useful in raising and aligning a food debris macerator for mating with an attachment structure fixed to the drain of a sink, comprising:

mounting means provided with a generally vertical bore having an opening in the upper end thereof and a radial recess adjacent said upper opening;

a threaded rod defined by an upper and a lower end threadably engaged to extend said lower end through a nut assembly for receipt in said upper opening and to threadably extend said upper end through a sleeve provided with an offset bar extending over said nut assembly into said recess; and an adapter attachable to said upper end of said rod and conformed to support said macerator.

7. An assembly according to claim 6, wherein:

said rod is selected from a group of rods of various lengths; and said adapter is selected from a group of adapters each conformed for supporting a particularly configured macerator.

8. An assembly according to claim 7, wherein:

said rod is selected from a group of rods of various lengths; and said adapter is selected from a group of adapters each conformed for supporting a particularly configured macerator.

* * * * *